US007554269B2

(12) United States Patent
Kim

(10) Patent No.: US 7,554,269 B2
(45) Date of Patent: Jun. 30, 2009

(54) PLASMA DISPLAY PANEL HAVING SPECIFIC STRUCTURE OF BUS ELECTRODES

(75) Inventor: Hyeong-Jun Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 569 days.

(21) Appl. No.: 11/253,655

(22) Filed: Oct. 20, 2005

(65) Prior Publication Data

US 2006/0082305 A1 Apr. 20, 2006

(30) Foreign Application Priority Data

Oct. 20, 2004 (KR) ..... 10-2004-0083873

(51) Int. Cl.
*H01J 17/49* (2006.01)

(52) U.S. Cl. ..... 313/585; 313/584; 313/582

(58) Field of Classification Search ..... 313/582–585
See application file for complete search history.

(56) References Cited

U.S. PATENT DOCUMENTS

| | | | | |
|---|---|---|---|---|
| 6,479,932 | B1 * | 11/2002 | Nunomura | 313/582 |
| 6,534,914 | B2 | 3/2003 | Amemiya et al. | |
| 6,630,790 | B2 | 10/2003 | Kanazawa et al. | |
| 7,208,875 | B2 | 4/2007 | Kwon et al. | |
| 7,208,876 | B2 | 4/2007 | Kang et al. | |
| 7,315,122 | B2 | 1/2008 | Kwon et al. | |
| 7,323,818 | B2 | 1/2008 | Kwon et al. | |
| 7,327,083 | B2 | 2/2008 | Woo et al. | |
| 7,425,797 | B2 | 9/2008 | Woo et al. | |
| 2004/0135509 | A1 | 7/2004 | Kwon et al. | |
| 2004/0256989 | A1 | 12/2004 | Kim et al. | |
| 2005/0001551 | A1 | 1/2005 | Kim et al. | |
| 2005/0052359 | A1 | 3/2005 | Kwon et al. | |
| 2006/0043891 | A1 | 3/2006 | Tessier et al. | |

FOREIGN PATENT DOCUMENTS

| | | | |
|---|---|---|---|
| JP | 09-129138 | | 5/1997 |
| JP | 09129138 A | * | 5/1997 |
| JP | 2001-216903 A | | 8/2001 |
| JP | 2002-075219 A | | 3/2002 |
| JP | 2002-150948 A | | 5/2002 |
| JP | 2004-214166 A | | 7/2004 |
| JP | 2005-011815 A | | 1/2005 |
| JP | 2005-531110 | | 10/2005 |
| JP | 2006-059631 A | | 3/2006 |
| KR | 10 2004 0062381 | | 7/2004 |

* cited by examiner

*Primary Examiner*—Karabi Guharay
(74) *Attorney, Agent, or Firm*—Lee & Morse, P.C.

(57) ABSTRACT

A plasma display panel having improved bus electrode layer structure helps to prevent defective non-discharging discharge cells. From the overlapped transparent electrode layer and the bus electrode layer of the plasma display panel, protrusions extend from respective line portions towards a center of corresponding discharge cells. The protrusions of the transparent electrode layer are longer in length than the protrusions of the bus electrode layer. The width of the bus electrode layer is wider than the base of the protrusion of the transparent electrode layer and provides electrical connectivity even when the base of the protrusion of the transparent electrode layer breaks.

12 Claims, 4 Drawing Sheets

PLASMA DISPLAY PANEL HAVING SPECIFIC STRUCTURE OF BUS ELECTRODES

BACKGROUND OF THE INVENTION

1. Field of the Invention

The present invention relates to a plasma display panel. More specifically, the present invention relates to a plasma display panel having improved transparent electrode layer and bus electrode layer structures.

2. Description of the Related Art

In general, a plasma display panel (PDP) is a display device in which ultraviolet rays generated by gas discharge excite phosphors to produce an image and has an advantage of its large screen with thin depth and high resolution over a cathode ray tube. At its essence, a PDP is a matrix of tiny fluorescent lamp pixels which are controlled using electronic drivers in a complex electronic driving scheme.

In a typical alternating current PDP, discharge cells are defined by barrier ribs placed between a front substrate and a rear substrate. Corresponding to each discharge cell, address electrodes are formed on the rear substrate, and display electrodes comprising sustain electrodes and scan electrodes are formed on the front substrate. The address electrodes and the display electrodes are covered with a respective dielectric layer. Each discharge cell has a phosphor layer that emits one of red, blue or green visible light when exposed to ultraviolet light and is filled with a discharge gas (generally a gas mixture of Ne—Xe). Each pixel of the PDP is formed by three adjacent ultraviolet light emitting discharge cells. The ultraviolet light is converted into visible light by the phosphors in each of the three adjacent discharge cells to produce each of the three primary colors, red, blue or green, in varying degrees in the respective discharge cells to produce a specific color in the pixel. The amount of visible light produced in each discharge cell depends on the level of ultraviolet light generated in each discharge cell by the electronic drivers.

In such a PDP, a discharge cell for light emission is selected by the address discharge that occurs by an address voltage applied between the address electrode and the scan electrode. Then, a plasma discharge takes place inside the selected discharge cell by a sustain voltage (Vs) applied between the sustain electrode and the scan electrode, and the plasma emits vacuum ultraviolet rays that excite the phosphor layer in the discharge cell to emit visible light.

For the operation of the PDP, the sustain electrode and the scan electrode are made of a transparent electrode layer such as indium-tin oxide (ITO) so that both the electrodes can transmit the visible light generated inside the discharge cell. The conductance of each transparent electrode layer is compensated by a bus electrode layer made of a metallic material such as silver. The bus electrode layer having a uniform line-width is formed in stripe-pattern on one side of the transparent electrode layer.

The transparent electrode may be formed by (1) forming an ITO layer on the entire front substrate, (2) forming a mask layer on the ITO layer by a well known photolithography process, (3) etching the unmasked ITO layer and (4) stripping the mask layer and cleaning/drying.

The transparent electrode layer of early PDPs was formed in a stripe pattern, and characteristics of discharging in the discharge cell were influenced by only the line-width and the discharge gap thereof. In order to improve discharge efficiency, however, a new structure has recently been introduced in which the line-width of the transparent electrode layer is reduced in the non-discharge region between the discharge cells and in the area contributing substantially little to the sustain discharge, i.e., the area corresponding to outer portions of the discharge cell. This type of transparent electrode layer, however, is susceptible to breakage at locations where there is a small line-width, due to a variety of factors, including poor bonding between the ITO layer and the mask layer, bubbles trapped in the mask layer and excessive etching in the patterning process of the ITO layer. Such breakage of the transparent electrode layer results in a defective discharge cell where the expected discharge does not and cannot occur.

In the event that a transparent electrode layer is broken during the forming process of the display electrode, it is possible to manually repair the breakage by applying the same material as the bus electrode layer on the broken area. However, such repairing requires an additional repairing process while increasing manufacturing cost and lowering productivity.

SUMMARY OF THE INVENTION

The present invention is therefore directed to a plasma display panel having which substantially overcome one or more of the problems due to the limitations and disadvantages of the related art.

The present invention provides a plasma display panel that overcomes and manages breaks that may occur to the transparent electrode layer during manufacturing and enables what would otherwise be non-dischargeable discharge cells to become fully functional and thereby prevents the occurrence of defective discharge cells.

It is therefore a feature of an embodiment of the present invention to provide a plasma display panel having improved bus electrode layer structures. It is a further feature of an embodiment of the present invention to provide a plasma display panel having improved transparent electrode layer structures. Yet another feature of an embodiment of the present invention is to provide a plasma display panel having improved discharge cell structure. Still another feature of an embodiment of the present invention is to provide a plasma display panel having non-discharge regions to improve heat management of the plasma display panel.

At least one of the above and other features and advantages of the present invention may be realized by providing a plasma display panel having a first substrate and a second substrate facing each other, barrier ribs defining discharge cells between the first substrate and the second substrate, address electrodes formed in parallel along a first direction on the first substrate beneath the discharge cells, and display electrodes formed in a layered structure of a transparent electrode layer and a bus electrode layer on the second substrate, the transparent electrode layer and the bus electrode layer forming a pair of overlapping respective line portions adjacent the discharge cells in a second direction crossing the address electrodes, each of the transparent electrode layer and the bus electrode layer having protrusions, each protrusion extending from its respective line portion towards a center of a corresponding discharge cell, the protrusions of the transparent electrode layer being longer in length than the protrusions of the bus electrode layer.

In the plasma display panel of this embodiment, the protrusions of the transparent electrode layer may include a base and a head with each base extending from its respective line portion and with each head extending from its base over each discharge cell towards but not over the center of each discharge cell. Additionally, a width of the base of the protrusions of the transparent electrode layer may be narrower than a width of its head. Also, a width of the protrusions of the bus electrode layer may be wider than a width of the base of the protrusions of the transparent electrode layer. Moreover, the head of each protrusion of the transparent electrode layer may have a concave section formed along its side closest to the center of each discharge cell. Additionally, the second direction may be normal to the first direction. Further, the barrier ribs may further define non-discharge regions surrounded by discharge cells.

In another embodiment of the present invention, there is provided a plasma display panel having a first substrate and a second substrate facing each other, barrier ribs defining discharge cells and non-discharge regions between the first substrate and the second substrate, each discharge cell having opposed tapered ends, the non-discharge regions being adjacent the tapered ends of the discharge cells, address electrodes formed in parallel along a first direction on the first substrate and running beneath the opposed tapered ends of each of the discharge cells, and display electrodes formed in a layered structure of a transparent electrode layer and a bus electrode layer on the second substrate, the transparent electrode layer and the bus electrode layer forming a pair of overlapping respective line portions adjacent the discharge cells in a second direction crossing the address electrodes, each of the transparent electrode layer and the bus electrode layer having protrusions, each protrusion extending from its respective line portion towards a center of a corresponding discharge cell, the protrusions of the transparent electrode layer being longer in length than the protrusions of the bus electrode layer, and a base of each protrusion of the bus electrode layer being wider than a base of each protrusion of the transparent electrode layer.

The plasma display panel of the present invention maintains the scan electrodes and the sustain electrodes in working order by virtue of the protrusion portion of the bus electrode layer, which maintains the electrical connection of the transparent electrode layer, even when the electrical connection to the line portion of the transparent electrode layer is broken during patterning of the transparent electrode layer. Therefore, the plasma display panel of the present invention helps to ensure that each discharge cell is fully functional and operational and helps to effectively prevent the formation of non-discharging discharge cells.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION

Figure 1:
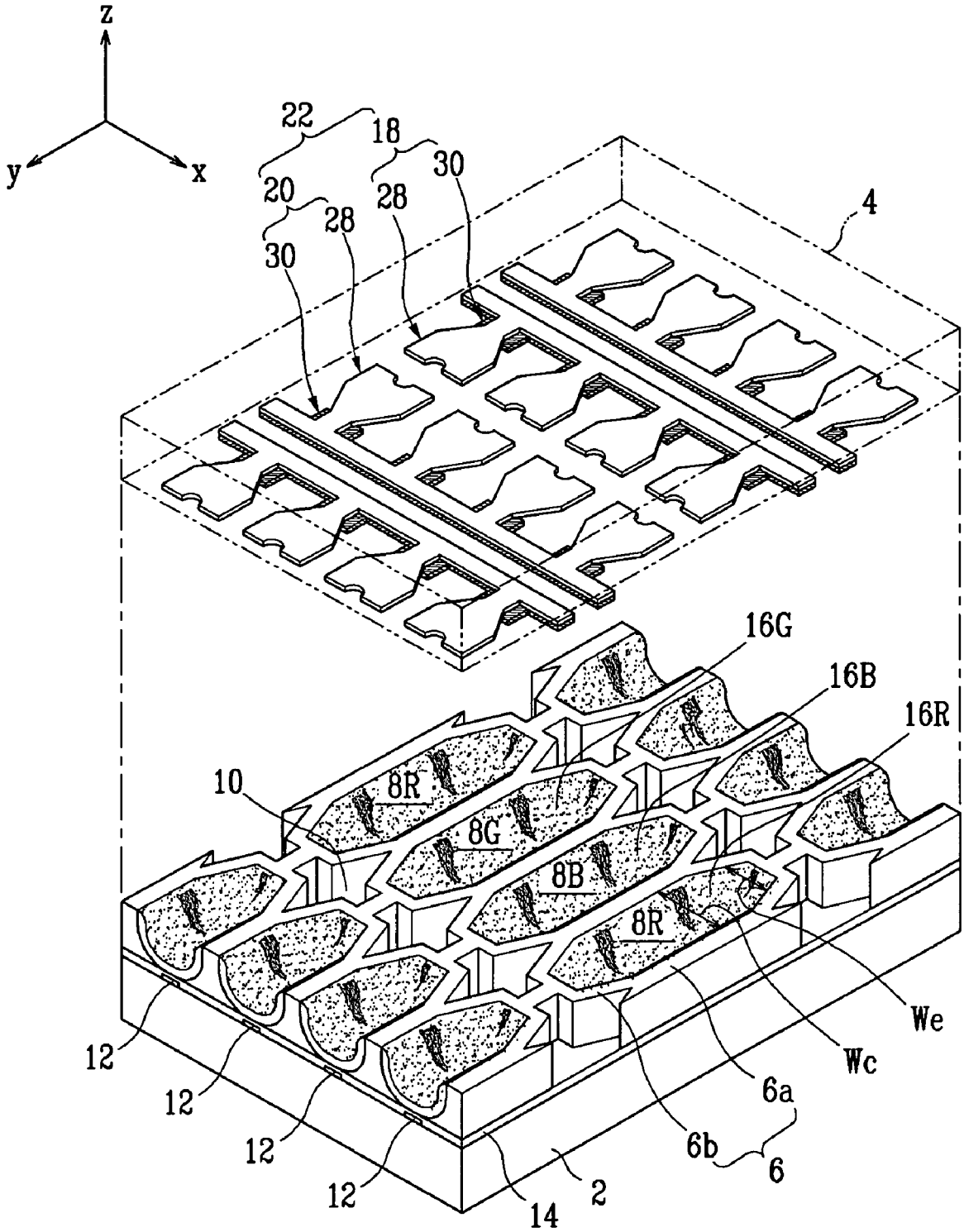
FIG. 1 illustrates a partial perspective view of a disassembled plasma display panel according to an exemplary embodiment of the present invention.

Korean Patent Application No. 10-2004-0083873 filed on Oct. 20, 2004, in the Korean Intellectual Property Office, and entitled "Plasma Display Panel," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
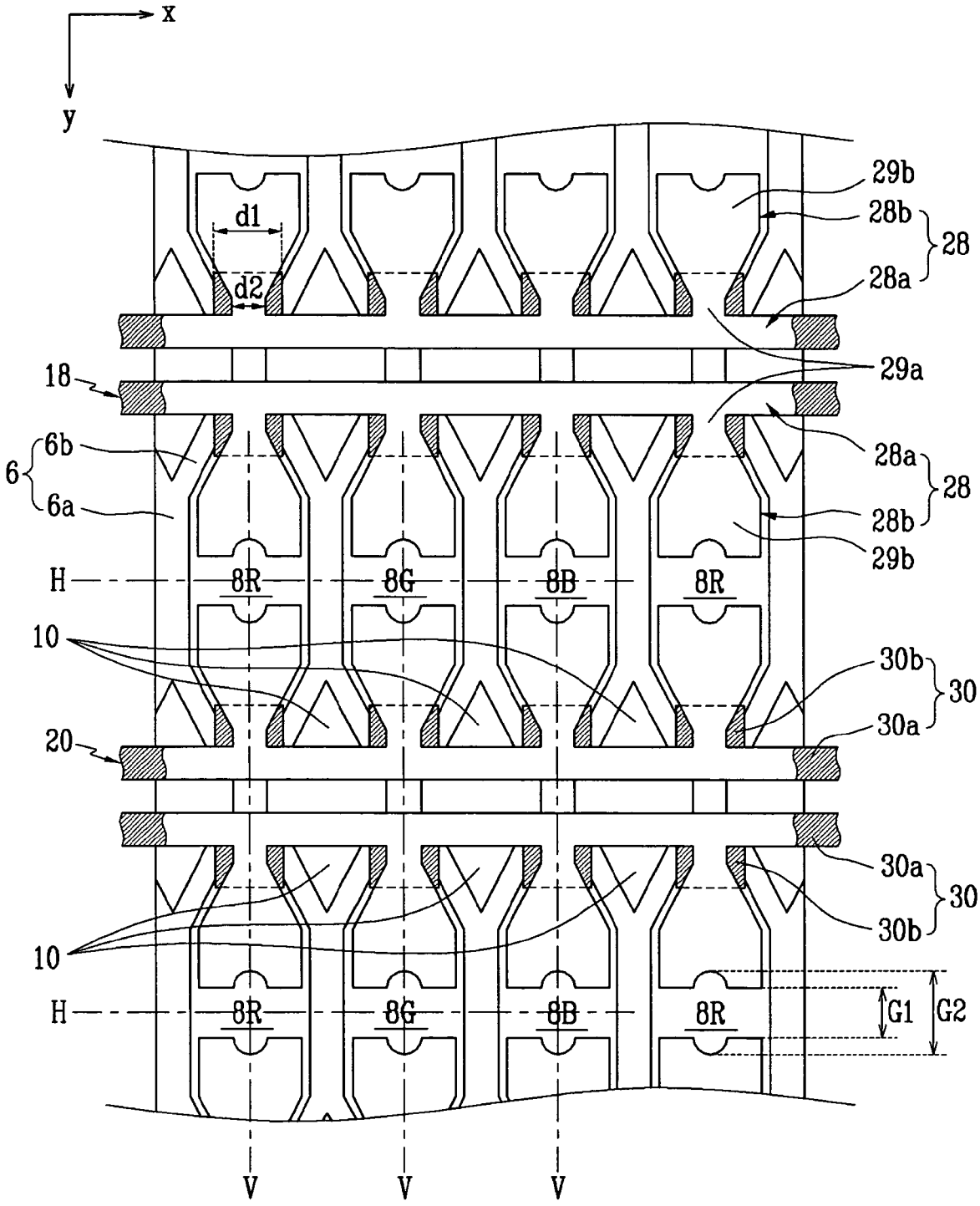
FIG. 2 illustrates a partial plan view of the plasma display panel illustrated in FIG. 1, as assembled.
Figure 3:
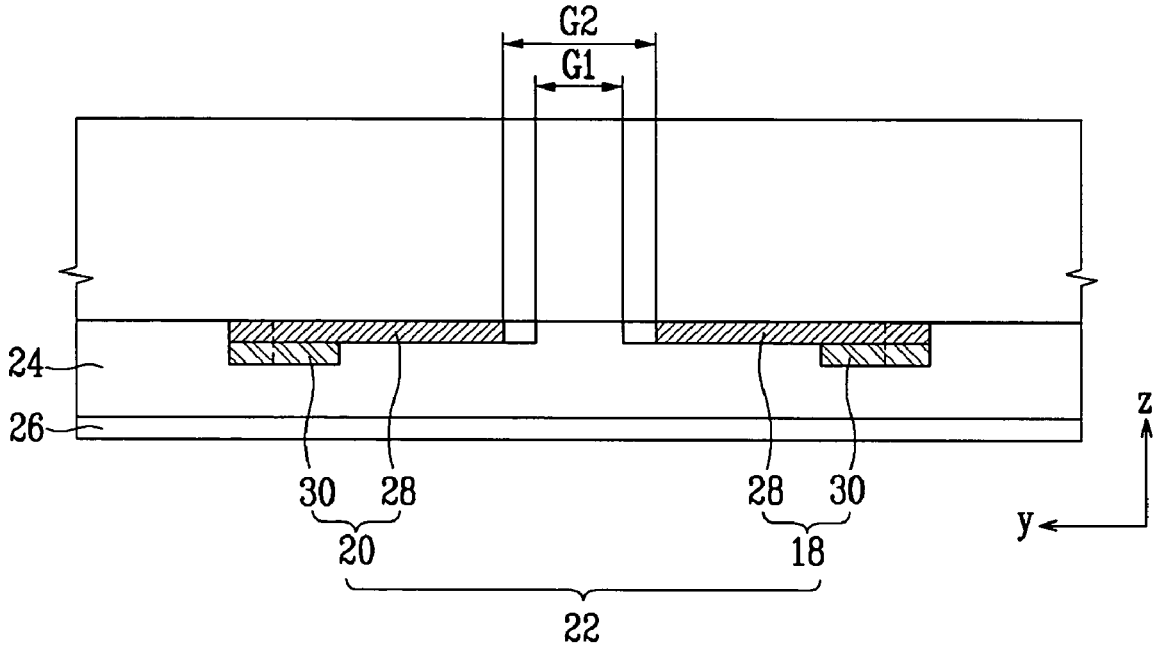
FIG. 3 illustrates a partial sectional view of the second substrate of the plasma display panel according to the exemplary embodiment of the present invention.

As shown in FIGS. 1-3, a plasma display panel (PDP) according to a preferred embodiment of the present invention includes a first substrate 2, a second substrate 4 facing the first substrate 2, the first and second substrates 2 and 4 being spaced apart from each other at a predetermined gap, discharge cells 8R, 8G, 8B and non-discharge regions 10 defined between the first substrate 2 and the second substrate 4 by barrier ribs 6 therebetween. A phosphor layer 16R, 16G, 16B with one of red, green and blue phosphors is coated on the inside of each discharge cell 8R, 8G, 8B.

Address electrodes 12 formed in one direction (Y-direction) on the inner surface of the first substrate 2 are covered by a first dielectric layer 14 formed on the entire inner surface of the first substrate 2. The address electrodes 12 may be, for example, in a stripe pattern so that each address electrode 12 is in parallel at a predetermined distance with neighboring address electrodes 12, i.e., each address electrode 12 is separated from each adjacent address electrode by a predetermined gap.

Barrier ribs 6 formed on the first dielectric layer 14 define discharge cells 8R, 8G, 8B, and non-discharge regions 10. Gas discharge and light emission occur in the discharge cells 8R, 8G, 8B, and do not occur in the non-discharge regions 10. The drawing figures illustrate an exemplary structure of the discharge cells 8R, 8G, 8B and the non-discharge region 10 having respective independent cells. The barrier ribs 6 form the discharge cells 8R, 8G, 8B in a direction (x-axis) that crosses, i.e., that is normal to, the extending or traveling direction (y-axis) of the address electrodes 12.

Each of the discharge cells 8R, 8G, 8B is optimized in shape or configuration for propagation of gas discharge in a manner such that regions contributing substantially less to sustain discharge and luminance are reduced. Specifically, the terminal portions or ends of each of the discharge cells 8R, 8G, 8B in the traveling direction (y-axis) of the address electrode are made to be increasingly narrower in width as they extend away from the center of the discharge cells 8R, 8G, 8B, i.e., the terminal portions or ends are tapered. As seen in FIG. 1, a width ($W_c$) at the center of the discharge cell 8R, 8G, 8B is made greater than a width ($W_e$) towards the terminal portions or ends thereof. The width ($W_e$) towards the terminal portions or ends becomes smaller, i.e., tapered, as it extends away from the center of the discharge cell 8R, 8G, 8B. With this type of structure, the terminal portions or ends of the discharge cells 8R, 8G, 8B become trapezoidal, and the overall shape of the discharge cells 8R, 8G, 8B becomes octagonal in plan view.

Referring to FIGS. 1 and 2, non-discharge regions 10 are defined by the barrier ribs forming the tapered ends of a cluster of neighboring or adjacent discharge cells. As such, one common non-discharge region 10 is positioned between four neighboring or adjacent discharge cells. The non-discharge region 10 serves to absorb heat from the neighboring or adjacent discharge cells and channel and dissipate the heat outside of the PDP. For this arrangement, the barrier ribs 6 include first barrier rib members 6*a* that are parallel to the address electrodes 12 and second barrier rib members 6*b* that are transverse to the first barrier rib members 6*a* at a predetermined angle. As an example and as shown in FIGS. 1 and 2, the present embodiment shows the second barrier rib members 6*b* formed in a loose X shape, i.e., double forked configuration, between two neighboring discharge cells in the extending or traveling direction of the address electrodes 12.

Referring again to FIGS. 1-3, display electrodes 22 including scan electrodes 18 and sustain electrodes 20 may be formed on the inner surface of the second substrate 4 facing the first substrate 2. Both the scan electrodes 18 and sustain electrodes 20 may be formed in a direction (x-axis) crossing or normal to the extending or traveling direction of the address electrodes 12 (y-axis), as illustrated in the drawing figures. A transparent second dielectric layer 24 and a MgO protective layer 26 may be formed on the entire inner surface of the second substrate 4 and covers the display electrodes 22.

In the present embodiment, both the scan electrode 18 and the sustain electrode 20 may be made into a layered structure including a transparent electrode layer 28 and a bus electrode layer 30. The transparent electrode layer 28 may be formed to increase the opening ratio of a PDP and may be made of, e.g., indium-tin oxide (ITO). The bus electrode layer 30 may be made of, e.g., silver (Ag) or a multi-layered material of chrome/copper/chrome (Cr)(Cu)(Cr), and serves to compensate the conductance of the transparent electrode layer 28 and to prevent voltage drop of the display electrode 22.

The transparent electrode layer 28 may include line portions 28*a* placed at positions corresponding to two facing sides of each of the discharge cells 8R, 8G, 8B and protrusions 28*b* extending from the respective line portions 28*a* towards the center of each discharge cell 8R, 8G, 8B. The protrusions 28*b* of the transparent electrode layer 28 may be formed to match the shape of the discharge cells 8R, 8G, 8B, and as such, include a base 29*a* and a head 29*b*. The base 29*a* extends from its respective line portion 28*a*, and each head 29*b* extends from its base 29*a* over each discharge cell towards but not over the center of each discharge cell. The sides of the head 29*b* are tapered towards the base 29*a*, and the width of the head 29*b* is wider than the width of the base 29*a*.

Referring to FIGS. 2 and 3, for each discharge cell 8R, 8G, 8B, the corresponding scan and sustain electrodes 18, 20 may be arranged so as to have a first gap G1 and a second gap G2. First gap G1 and second gap G2 are different in size and formed between two facing protrusions 28*b*. The head 29*b* of each protrusion 28*b* may have a concave or indented part formed along its side closest to the center of the discharge cell. As such, the two concave or indented sections of two heads 29*b* of two facing protrusions 28*b* are separated by gaps G1 and G2 above and around the center of each discharge cell. The first gap G1 is shorter than the second gap G2 and is located and measured between the closest edges of the head 29*b* of the two facing protrusion portions 28*b*. The second gap G2 is located and measured between the far edges of the two concave or indented sections of the heads 29*b* of the two facing protrusions 28*b*.

The main discharge between the scan electrode 18 and the sustain electrode 20 occurs initially in first gap G1 corresponding to the peripheral area of the discharge cell 8R, 8G, 8B, and then migrates to the second gap G2 corresponding to the central area of the discharge cell 8R, 8G, 8B so that the discharge spreads through the entire cell of each discharge cell 8R, 8G, 8B. Consequently, the first gap G1 serves to lower the voltage required for discharging, and the second gap G2 guides the discharging to the center of the discharge cells 8R, 8G, 8B to effect stable, consistent and reliable discharging.

In addition, the bus electrode layer 30 may include line portions 30*a* formed on the line portions 28*a* of the transparent electrode layer 28 and protrusion portions 30*b* formed with a shorter extension from the respective line portion 30*a* than the extension of the protrusion portion 28*b* of the transparent electrode layer 28. In the present embodiment, the protrusion portion 30*b* of the bus electrode layer 30 is formed on and to be overlapped with the rear tapered part, i.e., the base 29*a* and the tapered portion of the head 29*b*, of the protrusion portion 28*b* of the transparent electrode layer 28. In a preferred embodiment, the protrusion portion 30*b* of the bus electrode layer 30 has a width d1, measured in the extending or traveling direction of the line portion 30*a*, that is greater than a minimum width d2 of the base 29*a*, measured in the same direction, of the protrusion portion 28*b* of the transparent electrode layer 28.

Figure 4:
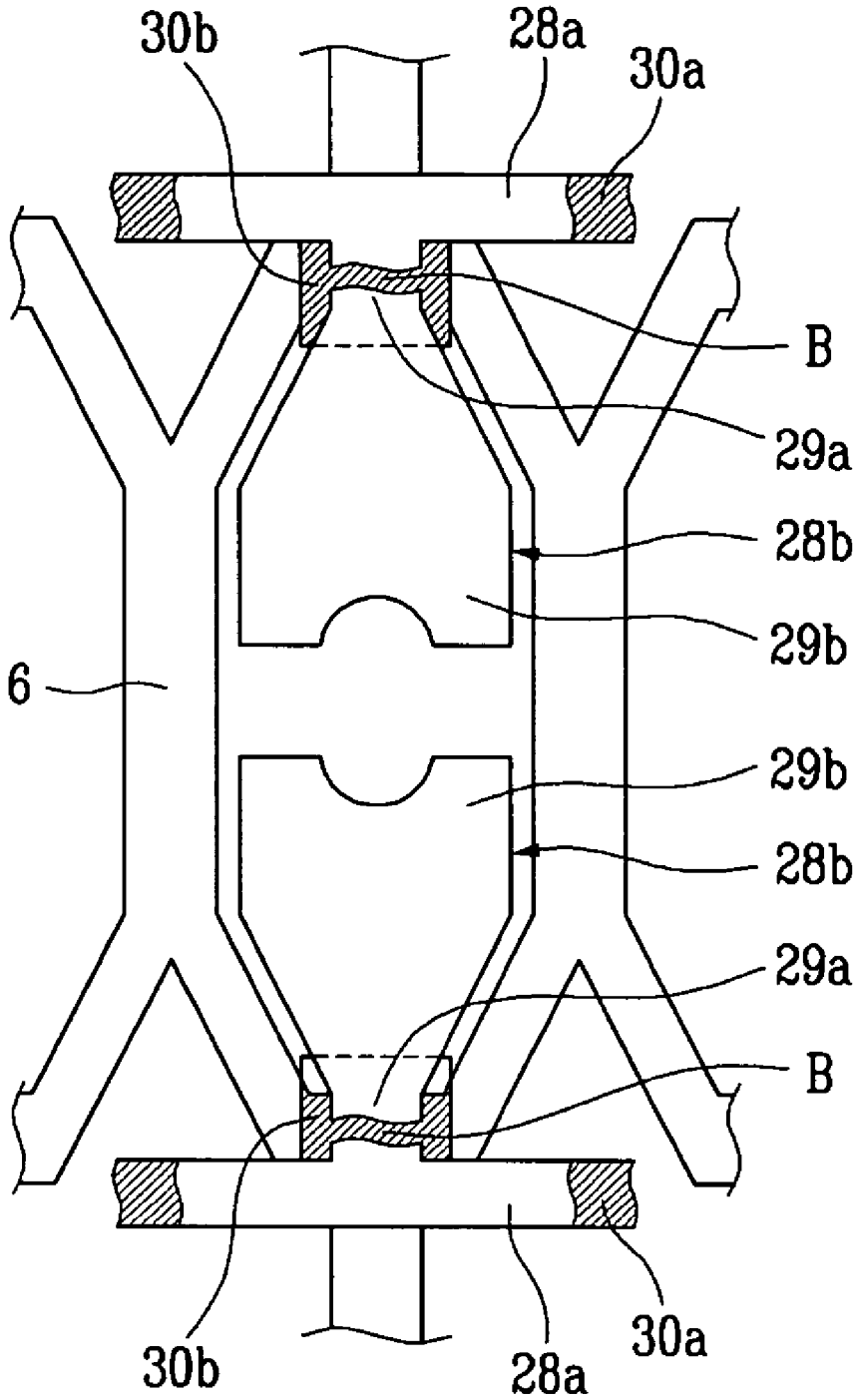
FIG. 4 illustrates a partial plan view of the plasma display panel, having a patterning failure on the transparent electrode layer, according to the exemplary embodiment of the present invention.

Therefore, both the line portion 28*a* and the protrusion portion 28*b* of the transparent electrode layer 28 may stay in electrical connection with each other via the electrical connection provided by the protrusion portion 30*b* of the bus electrode layer 30, even when, as shown in FIG. 4, the protrusion portion 28*b* of the transparent electrode layer 28 suffers from being broken (B) and electrically disconnected with the line portion 28*a* during the patterning of the transparent electrode layer 28 by, e.g., wet etching or laser etching.

In accordance with the benefits and advantages of the present invention, a PDP of the present invention does not suffer from failure in patterning the transparent electrode layer 28 and effectively eliminates the negative effects of defective discharge cells wherein expected discharge does not occur.

The shape or configuration of the discharge cells 8R, 8G, 8B and the non-discharge region 10 are not limited by the aforementioned example. Moreover, the various features of the present invention may be readily applied individually or in combination to a PDP having discharge cells 8R, 8G, 8B between a first substrate 2 and the second substrate 4.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel, comprising:

a first substrate and a second substrate facing each other;

barrier ribs defining discharge cells between the first substrate and the second substrate;

address electrodes formed in parallel along a first direction on the first substrate beneath the discharge cells; and display electrodes formed in a layered structure of a transparent electrode layer and a bus electrode layer on the second substrate, the transparent electrode layer and the bus electrode layer forming a pair of overlapping respective line portions adjacent the discharge cells in a second direction crossing the address electrodes, each of the transparent electrode layer and the bus electrode layer having protrusions, each protrusion extending from its respective line portion towards a center of a corresponding discharge cell, the protrusions of the transparent electrode layer being longer in length than the protrusions of the bus electrode layer and overlapping the protrusions of the bus electrode layer, and a base width of each protrusion of the bus electrode layer being wider than at least a portion of a corresponding overlapping protrusion of the transparent electrode layer.

2. The plasma display panel as claimed in claim 1, wherein each protrusion of the transparent electrode layer includes a base and a head, each base extending from its respective line portion, each head extending from its base over each discharge cell towards but not over the center of each discharge cell.

3. The plasma display panel as claimed in claim 2, wherein a width of the base of each protrusion of the transparent electrode layer is narrower than a width of its head.

4. The plasma display panel as claimed in claim 2, wherein a width of each protrusion of the bus electrode layer is wider than a width of the base of each protrusion of the transparent electrode layer.

5. The plasma display panel as claimed in claim 2, wherein the head of each protrusion of the transparent electrode layer has a concave section formed along its side closest to the center of each discharge cell.

6. The plasma display panel as claimed in claim 1, wherein the second direction is normal to the first direction.

7. The plasma display panel as claimed in claim 1, wherein the barrier ribs further define non-discharge regions surrounded by discharge cells.

8. A plasma display panel, comprising:

a first substrate and a second substrate facing each other;

barrier ribs defining discharge cells and non-discharge regions between the first substrate and the second substrate, each discharge cell having opposed tapered ends, the non-discharge regions being adjacent the tapered ends of the discharge cells;

address electrodes formed in parallel along a first direction on the first substrate and running beneath the opposed tapered ends of each of the discharge cells; and display electrodes formed in a layered structure of a transparent electrode layer and a bus electrode layer on the second substrate, the transparent electrode layer and the bus electrode layer forming a pair of overlapping respective line portions adjacent the discharge cells in a second direction crossing the address electrodes, each of the transparent electrode layer and the bus electrode layer having protrusions, each protrusion extending from its respective line portion towards a center of a corresponding discharge cell, the protrusions of the transparent electrode layer being longer in length than the protrusions of the bus electrode layer, and a base of each protrusion of the bus electrode layer being wider than a base of each protrusion of the transparent electrode layer.

9. The plasma display panel as claimed in claim 8, wherein the protrusion of the transparent electrode layer includes a base and a head, each base extending from its respective line portion, each head extending from its base over each discharge cell towards but not over the center of each discharge cell.

10. The plasma display panel as claimed in claim 9, wherein a width of the base of each protrusion of the transparent electrode layer is narrower than a width of its head.

11. The plasma display panel as claimed in claim 9, wherein the head of each protrusion of the transparent electrode layer has a concave section formed along its side closest to the center of each discharge cell.

12. The plasma display panel as claimed in claim 8, wherein the second direction is normal to the first direction.

* * * * *